US008152969B2

(12) United States Patent
Bartelmuss et al.

(10) Patent No.: US 8,152,969 B2
(45) Date of Patent: Apr. 10, 2012

(54) HYDROFOIL FOR A PAPERMAKING INSTALLATION

(76) Inventors: Klaus Bartelmuss, Teufenbach (AT); Heinz Bartelmuss, Teufenbach (AT)

( * ) Notice: Subject to any disclaimer, the term of this patent is extended or adjusted under 35 U.S.C. 154(b) by 1231 days.

(21) Appl. No.: 11/861,386

(22) Filed: Sep. 26, 2007

(65) Prior Publication Data

US 2008/0087398 A1 Apr. 17, 2008

(30) Foreign Application Priority Data

Oct. 16, 2006 (AT) ..... A 1710/2006

(51) Int. Cl.
*D21F 1/10* (2006.01)

(52) U.S. Cl. ..... 162/352; 162/351
(58) Field of Classification Search ..... 162/352, 162/351, 374, 274
See application file for complete search history.

(56) References Cited

U.S. PATENT DOCUMENTS

| | | | | | |
|---|---|---|---|---|---|
| 3,869,344 | A | * | 3/1975 | Hunt | 162/274 |
| 3,870,597 | A | * | 3/1975 | Getman et al. | 162/352 |
| RE29,418 | E | * | 9/1977 | Hunt | 162/274 |
| 4,265,706 | A | | 5/1981 | Fulton | |
| 4,334,958 | A | * | 6/1982 | Baluha et al. | 162/352 |
| 4,425,189 | A | * | 1/1984 | Mimura | 162/352 |
| 7,387,709 | B2 | * | 6/2008 | Bartelmuss et al. | 162/352 |
| 2005/0205227 | A1 | * | 9/2005 | Bartelmuss et al. | 162/352 |

FOREIGN PATENT DOCUMENTS

| | | | |
|---|---|---|---|
| DE | 2026457 | A1 | 12/1970 |
| EP | 0010924 | A1 | 5/1980 |
| WO | 8403314 | A1 | 8/1984 |

* cited by examiner

*Primary Examiner* — Mark Halpern
(74) *Attorney, Agent, or Firm* — Laurence A. Greenberg; Werner H. Stemer; Ralph E. Locher

(57) ABSTRACT

A hydrofoil for a paper production installation has a side that faces the wire formed with a wear strip. The wear strip is formed with plates that are organized in layer and formed of ceramic material. The wear strip is formed by a plurality of layers which lie on one another, each of thin plates which are situated next to one another. The layers of ceramic material are connected to one another by adhesive layers.

15 Claims, 4 Drawing Sheets

HYDROFOIL FOR A PAPERMAKING INSTALLATION

CROSS-REFERENCE TO RELATED APPLICATION

This application claims the priority, under 35 U.S.C. §119, of Austrian patent application A 1710/2006, filed Oct. 16, 2006; the prior application is herewith incorporated by reference in its entirety.

BACKGROUND OF THE INVENTION

Field of the Invention

The present invention relates to a hydrofoil, also referred to as a wire scraper or wiper strip, for paper production installations. The hydrofoil is configured on its side which faces the wire with a wear strip formed of plates that are arranged next to one another and are made from a ceramic material.

Papermaking or paper production installations are configured with at least one wire which can be moved along the installation, a paper stock or pulp being applied to the wire at the beginning of the installation. The fluid, in particular water, which is contained in the paper stock is discharged over a first region of the movement of the wire. The paper material which is situated on the wire is dried over further regions of the movement of the latter, said paper material subsequently being raised from the wire and being processed further. Here, the wire is guided over hydrofoils. or scrapers, which serve firstly to support the wire and serve secondly to strip off the fluid which emerges from the paper stock from the underside of the wire or to exert a suction action on the paper stock. Hydrofoils of this type are arranged exchangeably in the installation which is fixed to the frame, in order for it to be possible for them to be replaced at any time by a new hydrofoil.

Prior art wires are manufactured from a wire mesh made from a plastic material. On account of the hardness of this material, furthermore on account of the speed of approximately 30 m/s, at which the wire is moved over the hydrofoil, and finally on account of the aggressiveness of the fluids which emerge from the paper stock, the hydrofoils which support the wire are subjected to very high wear, for which reason they have to be configured with a wear-resistant coating on the side which faces the wire.

For this purpose, known hydrofoils which are manufactured, for example, from a glass fiber reinforced plastic material are covered on their side which faces the wire over their entire length with plates which are made from a ceramic material, in particular from aluminum oxide, by way of which a wear strip is formed. These known plates have, for example, a width which corresponds to the hydrofoil, a length which corresponds to twice the width and a thickness of from approximately 5 mm to 8 mm.

Plates of this type which are made from a ceramic material and are manufactured in a sintering process are firstly very expensive in terms of their manufacture. Secondly, they can be machined only with great expenditure, as a result of which high costs likewise are necessary. Since the ceramic material which is used for their manufacture is additionally very brittle, these plates are subjected to a great risk of fractures and cracks during their use for coating hydrofoils, which fractures or cracks therefore have to be avoided, since the wire which is moved over them is damaged by the edges which are formed as a result.

Damage to the plates as a result of fractures of the same can therefore be caused, since the surfaces of the plates are warmed in a pronounced manner on account of the wire which is moved over them, and since the plates which are made from a ceramic material have a very low thermal conductivity, for which reason great thermal stresses occur in plates of this type.

A further disadvantage in the use of plates of this type which are made from a ceramic material for coating a hydrofoil consists in the fact that there are joint gaps which extend in the movement direction of the wire, as a result of which the stripping action of the hydrofoil which extends transversely with respect to the wire does not have the desired uniformity over the width of the wire.

SUMMARY OF THE INVENTION

It is accordingly an object of the invention to provide a scraper for a paper production installation which overcomes the above-mentioned disadvantages of the heretofore-known devices and methods of this general type and which provides for a further improved scraper.

With the foregoing and other objects in view there is provided, in accordance with the invention, a hydrofoil for a papermaking installation, comprising:

a carrier strip;

a wear strip mounted to said carrier strip on a side thereof configured to face towards a wire;

said wear strip including a plurality plates of ceramic material, said plates being disposed in a plurality of layers each formed of a plurality of adjacently disposed thin ceramic plates and being connected to each other by way of an adhesive layer.

In other words, the objects of the invention are achieved by the fact that the wear strip is formed by a plurality of layers which lie on one another of thin plates which are situated next to one another, are made from a ceramic material and are connected to one another by adhesive layers.

As a result of a configuration of this type of the wear strip, substantially lower thermal stresses are caused in the plates firstly on account of the considerably lower thicknesses of the individual plates which are built up on one another, in comparison with conventional plates made from a ceramic material. Additionally, a wear strip of this type which is built up is substantially more elastic, on account of the adhesive layers which are situated between the individual plates, than is the case for known wear strips which comprise individual plates which are arranged next to one another and are made from a ceramic material, for which reason the risk of damage as a result of cracks or fractures to a wear strip of this type which is built up is substantially lower than is the case in previously known wear strips.

The plates of the layers which lie on one another are preferably configured with projections and recesses which are assigned to one another, as a result of which they are also locked to one another mechanically. Furthermore, the joint gaps of the plates which are situated in layers which lie directly next to one another are preferably offset with respect to one another.

According to one first preferred embodiment, the plates of the wear strip are situated approximately in the plane of the wire. According to a second preferred embodiment, the plates of the wear strip are oriented transversely with respect to the wire, with the result that the narrow sides of the plates of the wear strip lie opposite the wire. The wear strip can be connected to the hydrofoil carrier strip by adhesive bonding. Furthermore, the hydrofoil can be configured with a clamping device for fastening the wear strip, which clamping device preferably consists in that, on its surface which is assigned to the wire, the hydrofoil is configured with a stop strip and with a releasably fastened clamping strip, it being possible for the wear strip to be clamped between the stop strip and the clamping strip. Furthermore, the wear strip can be fastened to the carrier strip by the carrier strip being configured, on the side which faces the wire, over its length with a groove or with a strip, and by the wear strip being configured, on the side which faces the hydrofoil carrier strip, with a diametrically opposed strip and a groove, the respective strip being inserted into the groove.

The wear strip can have a rectangular or a trapezoidal cross section. Here, the wear strip can contain firstly plates of rectangular cross section and secondly plates of trapezoidal cross section, the plates of trapezoidal cross section preferably being situated on at least one of the two outer faces.

According to a further preferred embodiment, the plates which are arranged in the individual layers can be manufactured from ceramic materials of different hardnesses. Here, in particular, the plates which come into contact directly with the wire and the first plates of the wear strip in the movement direction of the wire can be manufactured from a very hard ceramic material, whereas the other plates can be manufactured from comparatively less hard and therefore somewhat less brittle ceramic materials.

Other features which are considered as characteristic for the invention are set forth in the appended claims.

Although the invention is illustrated and described herein as embodied in hydrofoil for paper production installation, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
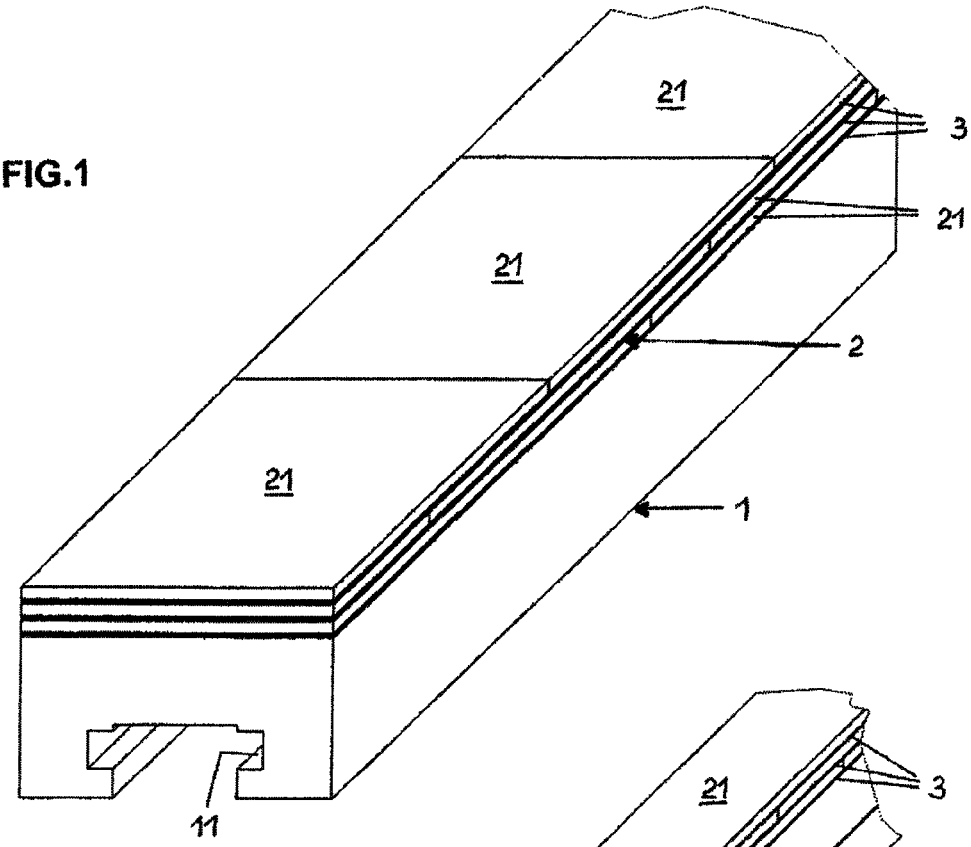
FIG. 1 is a partial, top perspective view of a first exemplary embodiment of a hydrofoil according to the invention.

Referring now to the figures of the drawing in detail and first, particularly, to FIG. 1 thereof, there is shown a hydrofoil, which may also be referred to as a wiper strip, a wiper, a screen foil, or simply a scraper, or even a wire foil. A carrier strip 1 is manufactured, for example, from glass fiber-reinforced plastic and is provided on its side which is assigned to the wire of a paper production installation with a wear strip 2. The wear strip 2 comprises a multiplicity of plates 21 which are built up on top of one another and are made from a ceramic material. The plates 21 are fastened to the surface of the hydrofoil 1 and to one another by way of adhesive layers 3.

In the embodiment which is shown, the wear strip 2 is formed by three layers of plates 21, the plates 21 of the layers which lie directly on one another being offset with respect to one another.

Due to the fact that, firstly, the plates 21 have a very low thickness (from about 0.5 mm to 1 mm or of up to a maximum of 3 mm) and, secondly, the adhesive layers 3 are situated between the plates 21, there is provided a hydrofoil 1 with a wear strip 2 that is substantially more elastic and therefore far less susceptible to fracture than prior art wear strips which have only a single layer of substantially thicker plates. As a result, the novel wear strip is damaged substantially less often than is the case for previously known wear strips. This is achieved in that firstly only small thermal stresses occur in the individual plates 21 on account of their very low thickness, and in that secondly the wear strip 2 has a substantially greater elasticity on account of the layered construction and the adhesive layers 3 which are situated between the individual plates 21, than is the case for known wear strips which comprise individual substantially thicker plates which lie next to one another and are made from a ceramic material.

The hydrofoil carrier strip 1 according to FIG. 1 is configured, on its side which faces away from the plates 21, over its entire length with an undercut groove 11, by means of which it can be fastened releasably to a carrying strip which is provided in the paper production installation, as a result of which it can be replaced at any time by a new hydrofoil.

Figure 2:
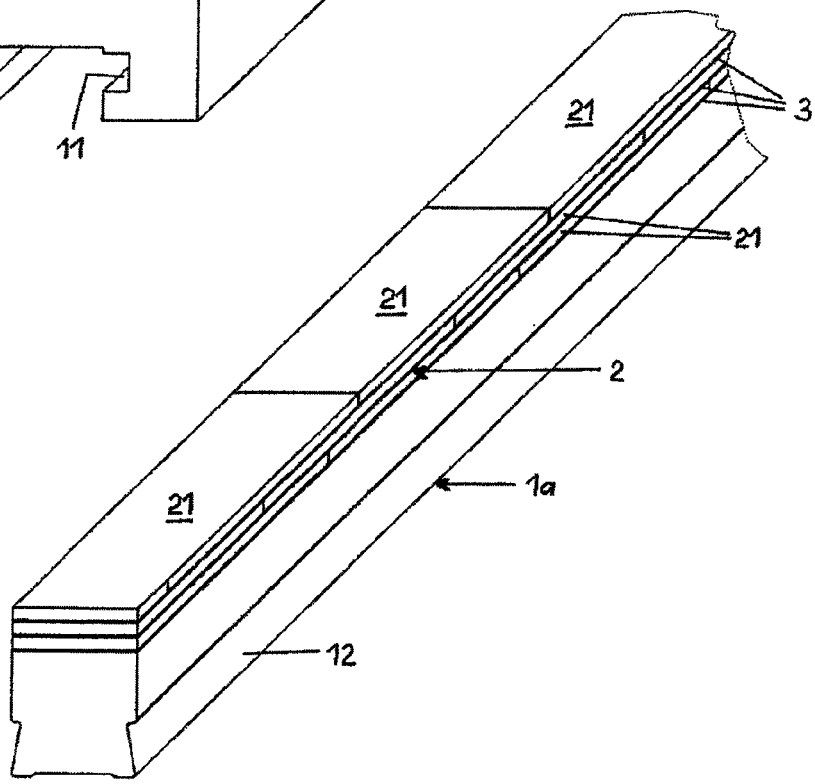
FIGS. 2-4 are similar views of three variations of the first exemplary embodiment shown in FIG. 1.

The hydrofoil 1*a* according to FIG. 2 differs from the hydrofoil 1 according to FIG. 1 only in that, on its side which faces away from the plates 21, it is configured over its entire length with a base 12 which is undercut on both sides, as a result of which it can be pushed into an associated groove of a carrying strip and can be fastened in this way to the latter.

Figure 3:
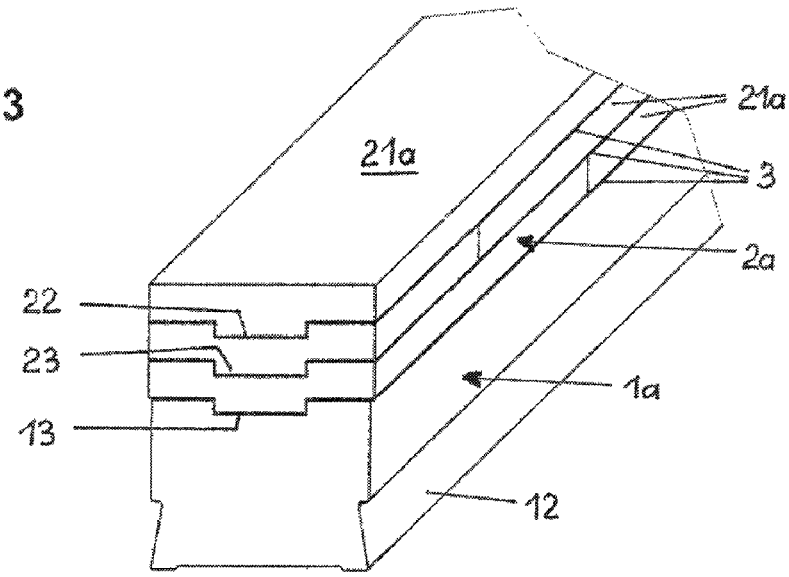

The hydrofoil 1*a* according to FIG. 3 differs from the hydrofoil 1*a* according to FIG. 2 in that the individual plates 21*a* of the wear strip 2*a* are configured in their central region on their upper side in each case with a groove 22 and on their lower side in each case with a protruding strip 23 which is diametrically opposed to the groove 22, the strips 23 protruding into the grooves 22 of the plates 21*a* which in each case lie underneath. In addition, the hydrofoil 1*a* is likewise configured on its upper side with a groove 13, into which the strip 23 of the adjacent plate 21*a* protrudes. As a result, in addition to the adhesive layers 3 which are situated between the individual layers of the plates 21*a*, mechanical locking of the individual plates 21*a* to one another is brought about.

Figure 4:
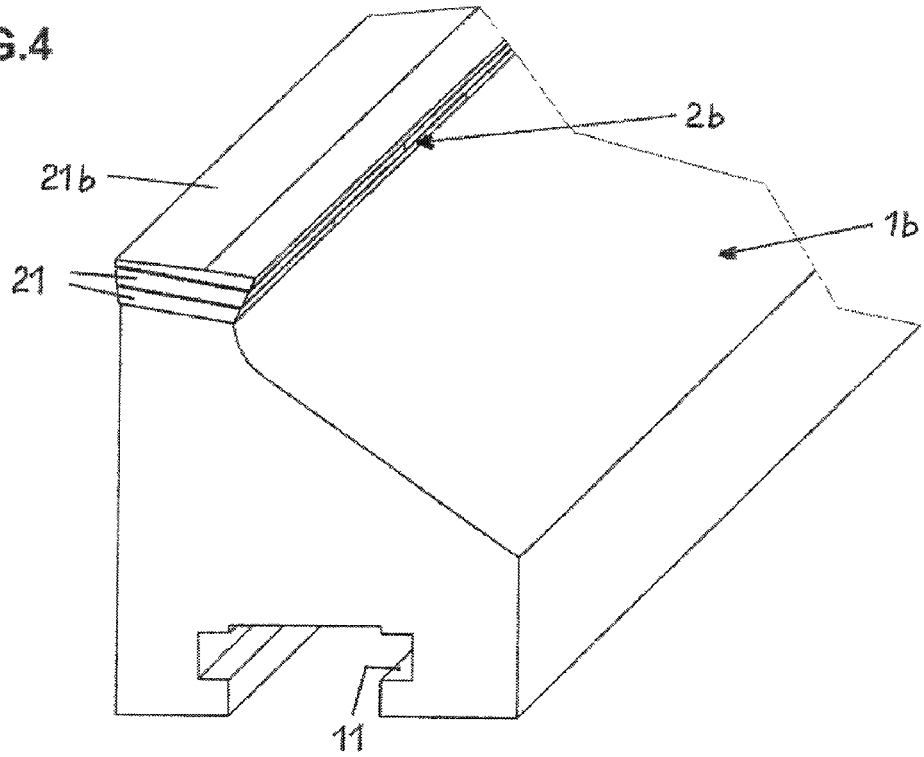

The hydrofoil 1*b* according to FIG. 4 differs from the design variants according to FIG. 1 to FIG. 3 in that the plates 21 and 21*b* of the wear strip 2*b* have different cross sections to the extent that the uppermost plates 21*b* have a trapezoidal cross section transversely with respect to the longitudinal extent of the wear strip 2*b*, the thickness of the plates 21*b* being reduced in the movement direction of the wire, whereas the other plates 21 have a uniform cross section over their entire surface area. This hydrofoil 1*b* is also configured with a fastening groove 11.

Figure 5:
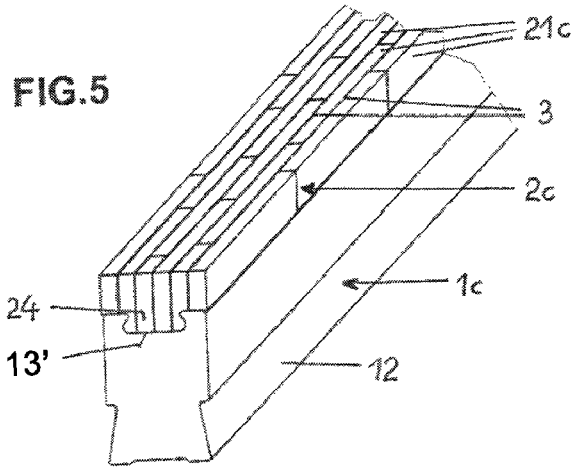
FIG. 5 is a partial, top perspective view of a second exemplary embodiment of the hydrofoil according to the invention.

The second embodiment which is shown in FIG. 5 of a hydrofoil 1*c* according to the invention differs from the first embodiment of a hydrofoil according to FIG. 1 to FIG. 4 in that the surfaces of the plates 21*c* of the wear strip 2*c* are not arranged approximately parallel to the wire, but rather are oriented transversely with respect to the wire, with the result that the latter comes into contact with the end faces of the plates 21*c*. Here, the plates 21*c* are also connected to one another by means of adhesive layers 3 which are situated between them.

Here, this wear strip 2*c* is fastened to the hydrofoil 1*c* in that the hydrofoil 1*c* is configured on its upper side which faces the wire with an undercut groove 13', into which a strip 24 which protrudes from the wear strip 2*c* protrudes. In order to fasten it to a carrying strip, the hydrofoil 1*c* is configured with a base 12 which is undercut on both sides.

Figure 6:
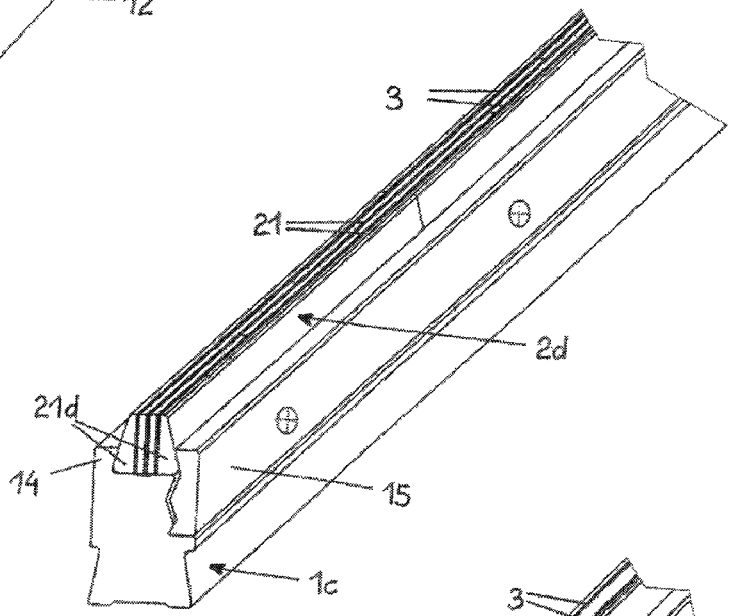
FIGS. 6-8 are similar views of three variations of the second exemplary embodiment of the hydrofoil shown in FIG. 5.
Figure 7:
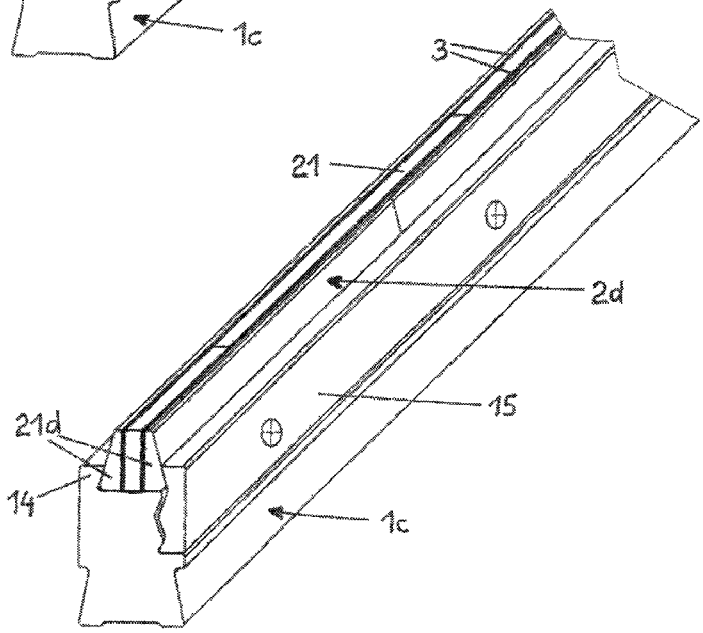

The design variants according to FIG. 6 and FIG. 7 differ from the embodiment according to FIG. 5 in the type of fastening of the wear strips 2*d* to the hydrofoil 1*c*. For this purpose, the hydrofoil 1*c* is configured on its side which is assigned to the wire with a stop strip 14 and, furthermore, a clamping strip 15 is provided which is fastened releasably to the hydrofoil 1*c*, it being possible for the wear strip 2*d* to be clamped between the stop strip 14 and the clamping strip 15. As a result, the wear strip 2*d* can be removed from the hydrofoil 1*c* in a very simple manner and can be replaced by a new wear strip 2*d*.

Here, the wear strip 2*d* differs from the wear strip 2*c* according to FIG. 5 in that it is formed by plates 21*d* of trapezoidal cross section which lie on the outside and by at least one layer of plates 21 of rectangular cross section which are situated between the plates 21*d*. Here, the plates 21 and 21*d* are also connected to one another by means of adhesive layers 3.

Figure 8:
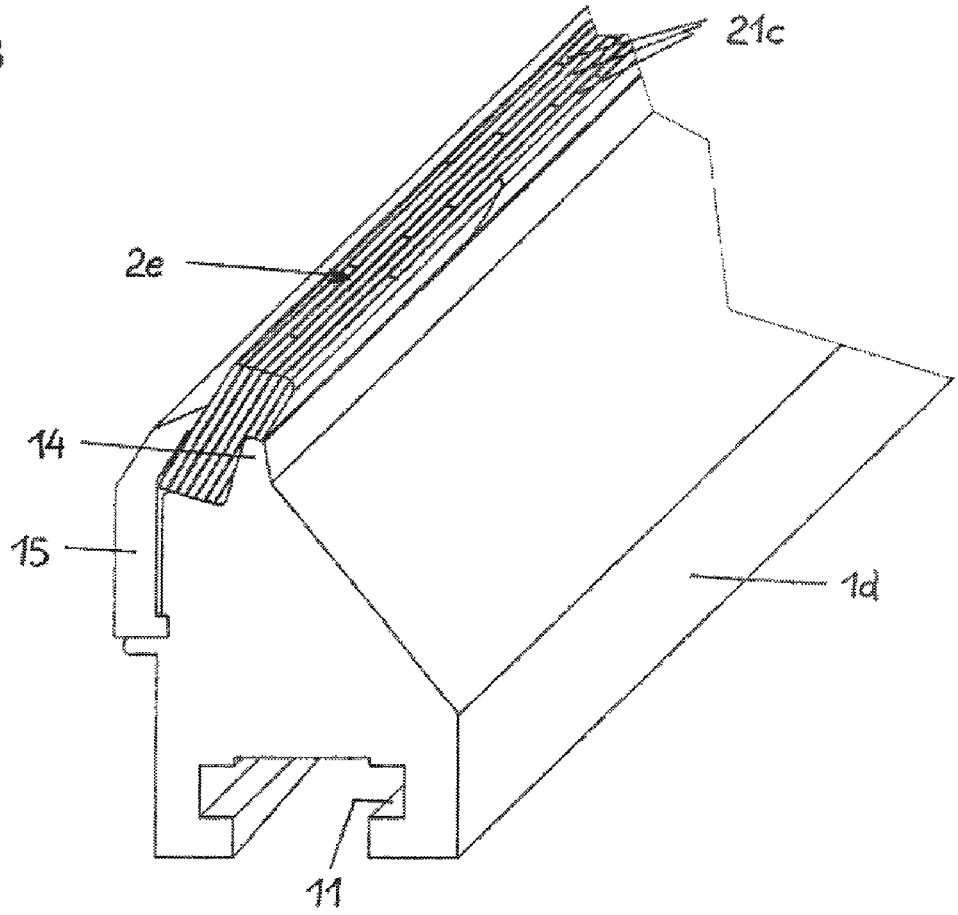

The design variant according to FIG. 8 differs from the design variants according to FIG. 6 and FIG. 7 in that the hydrofoil 1*d* which is configured with a groove 11, with a stop strip 14 and with a clamping strip 15 is provided with a wear strip 2*e* which comprises a plurality of layers of plates 21*c* which are adhesively bonded to one another and all have rectangular cross sections.

This second embodiment which is shown in FIG. 5 to FIG. 8 of a hydrofoil according to the invention firstly ensures the advantages of the first embodiment, namely reduced brittleness of the wear strip, as a result of which the risk of damage to the latter is reduced. Since the individual plates of the wear strip are offset with respect to one another in the longitudinal direction of the strip, they secondly do not have any continuous joint gaps in the movement direction of the wire on the face which bears against the wire, as a result of which the hydrofoil has the same effect over its entire length.

The individual plates 21, 21*a*, 21*b* and 21*c* can be manufactured from silicon carbide or aluminum oxide, zirconium oxide or silicon nitride. Here, silicon carbide represents the hardest and most brittle ceramic material. Aluminum oxide is somewhat less hard and brittle, and zirconium oxide and silicon nitride are somewhat less hard and brittle than aluminum oxide. Here, the individual layers of the wear strip can be manufactured from different ceramic materials. The plates which come into contact with the wire or those plates, on which the wire runs, are preferably manufactured from a very hard ceramic material, whereas the plates which lie underneath or the plates which follow in the movement direction of the wire are manufactured from a somewhat less hard ceramic material. As a result, the wear strip has very high wear strength and, in addition, high elasticity.

The invention claimed is:

1. A hydrofoil for a papermaking installation, comprising:

a carrier strip;

a wear strip mounted to said carrier strip on a side thereof configured to face towards a wire;

said wear strip including a plurality of planar plates of ceramic material each having a thickness of between 0.5 mm and 3 mm, said plates being disposed in at least three layers each formed of a plurality of said ceramic plates disposed adjacent one another in a longitudinal direction of said wear strip, and adhesive layers connecting said ceramic plates to one another.

2. The hydrofoil according to claim 1, wherein said plates of said layers of said wear strip are formed with projections and associated recesses, said projections and recesses locking said plates to one another mechanically.

3. The hydrofoil according to claim 1, wherein said plates within each said layer define joints therebetween, and wherein said joints of respective said layers that lie directly on top of one another are offset with respect to one another relative to a vertical.

4. The hydrofoil according to claim 1, wherein said plates of said wear strip are disposed approximately in a plane of the wire.

5. The hydrofoil according to claim 1, wherein said plates of said wear strip are oriented transversely with respect to the wire, with narrow sides of said plates lying opposite the wire.

6. The hydrofoil according to claim 1, wherein said carrier strip and said wear strip are connected to one another by way of adhesive.

7. The hydrofoil according to claim 1, which comprises a clamping device for fastening said wear strip to said carrier strip.

8. The hydrofoil according to claim 7, wherein said carrier strip, on a side thereof assigned to the wire, is formed with a stop strip and with a releasably fastened clamping strip, said stop strip and said clamping strip being configured to clamp said wear strip therebetween.

9. The hydrofoil according to claim 1, wherein said wear strip has a trapezoidal cross section.

10. The hydrofoil according to claim 9, wherein said wear strip includes first plates of rectangular cross section and second plates of trapezoidal cross section.

11. The hydrofoil according to claim 10, wherein said second plates are disposed on at least one of two outer faces of said wear strip.

12. The hydrofoil according to claim 1, wherein:

said carrier strip, on the side thereof facing towards the wire, is formed with a groove or with a strip over an entire length thereof; and said wear strip, on a side thereof facing towards said carrier strip, is formed with a diametrically opposed strip and a groove; and wherein the respective said strip is inserted into the respective said groove.

13. The hydrofoil according to claim 1, wherein said plates that are disposed in the individual said layers are manufactured from ceramic materials of mutually different hardness.

14. The hydrofoil according to claim 13, wherein said plates which come into contact with the wire and first plates of said wear strip in a movement direction of the wire are manufactured from a very hard ceramic material, and wherein further said plates are manufactured from comparatively less hard ceramic materials compared with the very hard ceramic material.

15. The hydrofoil according to claim 1, wherein said plates of ceramic material have a thickness of between 0.5 mm and 1 mm.

* * * * *